US007610843B2

(12) United States Patent
Beretta

(10) Patent No.: US 7,610,843 B2
(45) Date of Patent: Nov. 3, 2009

(54) INDIVIDUAL FIREARM WITH IMPROVED RECOCK DEVICE

(75) Inventor: Ugo Gussalli Beretta, Gardone Val Trompia (IT)

(73) Assignee: Fabrica d'Armi Pietro Beretta S.p.A., Gardone Val Trompia (Brescia) (IT)

( * ) Notice: Subject to any disclaimer, the term of this patent is extended or adjusted under 35 U.S.C. 154(b) by 196 days.

(21) Appl. No.: 11/191,836

(22) Filed: Jul. 28, 2005

(65) Prior Publication Data

US 2007/0012169 A1 Jan. 18, 2007

(30) Foreign Application Priority Data

Aug. 3, 2004 (IT) ..... MI2004A1594

(51) Int. Cl.
*F41A 5/30* (2006.01)

(52) U.S. Cl. ..... 89/191.02; 89/191.01; 89/192; 89/193

(58) Field of Classification Search ..... 89/191.02, 89/191.01, 192, 193
See application file for complete search history.

(56) References Cited

U.S. PATENT DOCUMENTS

| | | | | |
|---|---|---|---|---|
| 2,814,972 | A * | 12/1957 | Simmons, Jr. | 89/193 |
| 2,865,256 | A * | 12/1958 | Marsh | 89/191.02 |
| 2,987,968 | A * | 6/1961 | Janson | 89/193 |
| 3,020,807 | A * | 2/1962 | Hailston et al. | 89/193 |
| 3,024,706 | A * | 3/1962 | Wild | 89/193 |
| 3,945,296 | A * | 3/1976 | Hyytinen | 89/191.02 |
| 3,990,348 | A * | 11/1976 | Vesamaa | 89/193 |
| 3,994,203 | A * | 11/1976 | Vymazal et al. | 89/193 |
| 4,635,530 | A * | 1/1987 | Weldle | 89/159 |
| 4,702,146 | A * | 10/1987 | Ikeda et al. | 89/193 |
| 5,177,320 | A * | 1/1993 | Reynolds | 89/193 |
| 5,429,034 | A * | 7/1995 | Badali et al. | 89/193 |
| 6,508,160 | B2 * | 1/2003 | Beretta | 89/191.02 |

FOREIGN PATENT DOCUMENTS

EP 0 114 204 8/1984

OTHER PUBLICATIONS

EPO Search Report.

* cited by examiner

*Primary Examiner*—Michael Carone
*Assistant Examiner*—Jonathan C Weber
(74) *Attorney, Agent, or Firm*—James V. Costigan; Hedman & Costigan, P.C.

(57) ABSTRACT

An individual firearm with improved recock device comprising a casing (12), a barrel (13), a breech bolt (14), a breech bolt slide (15), wherein the barrel (13) has at least one hole (32), or gas bleeding port, communicating with a gas intake cylinder (19) which houses a piston gas intake assembly (20), which is connected to operating rods (31) integral to the breech bolt slide (15), comprises at least one first inertial spring (27, 27') arranged between the breech bolt slide (15) and the gas intake cylinder (19), adapted for causing a variable, inertial and/or gas intake actuation.

7 Claims, 6 Drawing Sheets

INDIVIDUAL FIREARM WITH IMPROVED RECOCK DEVICE

The present invention relates to an individual firearm with improved recock device.

More particularly, it relates to semi-automatic firearms wherein, in other words, the cartridge is automatically loaded as a consequence of the firing of the previous one. This classification includes, obviously, also "automatic" firearms wherein also the firing is automatic, besides the loading.

The following description refers to the calibre 12 firearm category, particularly used for hunting and sporting firing, but since the invention is general, with proper adjustments it can be applied to all individual automatic or semi-automatic long barrel firearms, according to what defined above.

With particular reference to the calibre 12 hunting and firing rifle, the prior art relating to the devices that enable the recock of mobile masses and the consequent loading of a new cartridge in the cartridge chamber will be described without illustrative drawings, since these devices are already know to the man skilled in the art.

Among known systems that in a semi-automatic rifle enable the recock of mobile masses (consisting of breech bolt, breech bolt slide, etc.), for example long and short barrel recoil, blow back, gas intake and inertial systems can be mentioned.

Over the years, a natural selection of these systems has been noted, where the most widespread and therefore largely manufactured systems for cal. 12 hunting and firing rifles have become the gas intake and the inertial systems.

As known, gas intake rifles use a small part of the bullet launch energy through the bleeding of a certain amount of gas from the barrel, which is put in communication with a gas intake cylinder through suitable ports. The gas bled expands into a chamber of the gas intake cylinder and exerts an impulse on the mobile masses, usually through one or more operating rods. The action of this impulse causes an acceleration of said mobile masses up to reaching the minimum speed required for disengaging the closing members, extracting and ejecting the case of the fired bullet and retracting them to the receiver position, overcoming the frictions and the resistance of a return spring; once the receiver position has been reached, the mobile masses, pushed forward by the spreading of the return spring, actuate a supply mechanism and load the new cartridge and close the breech bolt.

The gas intake system, historically developed prior to the inertial one, is characterised by the reliability with limited power cartridges, even in non-optimal conditions of support of the rifle on the shoulder. Good performance in terms of minimum cartridge that can be fired means that the gas intake rifle allows complete recock also when a cartridge of limited power is fired, such as in the case of low weight firing cartridges (28 g., 24 g. or even 24 g. subsonic of cal. 12).

On the other hand, since the gas intake rifle rests, for its operation, on the gas bleeding from the barrel, it is affected by a soiling phenomenon due to the build up of dust residues, thus requiring a relatively hard maintenance.

Moreover, if the calibration used favours the use with weak cartridges, when the most powerful cartridges in the range are fired, it is affected by quite high recock speeds, even if gas cut off valves are used to protect the rifle mechanisms. Finally, with this calibration, in the gas intake rifle (for example, cal. 12), the weaker cartridges (24 g.) hardly allow the recock due to the low speeds of the mobile masses, while more powerful cartridges (Magnum 56/63 g) stress the mechanical members to their limits for the high recock speeds and therefore the high stress in the casing/slide impact.

The disadvantages described above for the rifle with gas intake recock device, in particular the problems of mechanical stresses in the use of high power cartridges and maintenance, are not present in rifles with inertial recock device, which however exhibit different disadvantages.

Inertial rifles use the recoil of the entire rifle, or of the casing, to compress a large spring arranged between breech bolt slide and breech bolt. Such large spring, once stored the compression energy, tends to spread again making the breech bolt slide accelerate backwards, relative to the casing, and the breech bolt slide then realises all the steps already described with reference to the gas intake rifle.

In the inertial operation, upon the explosion of the launch charge, the casing, violently pushed by gas pressure, is strongly accelerated backwards towards the shooter's shoulder. The breech bolt slide, tending by inertia to keep its rest position, carries out a compression action on the inertial spring, whose seat gets shorter due to the recoil of the casing and of the breech bolt constrained thereto. Since the firearm is of course still in closed condition, the breech bolt is firmly locked to the receiver. The spring compression will reach a certain extent, such as to allow the firearm, through the stored spring energy and the consequent backward launch of the slide, to carry out the recock cycle according to what described. The time over which the maximum spring compression is achieved cannot be too short to prevent causing, in the following backward launch of the slide, an early opening of the breech bolt; this result is achieved with the proper sizing of the elastic constant of the spring itself based on the size of the mobile masses.

From the point of view of mechanical stress, the inertial rifle is naturally favoured. In fact, owing to the loading of current cartridges and considering the typical rifle masses, it cannot exceed, even with the powerful Magnum cartridges, speeds having reasonable safety values.

However, this particularly favourable condition has a very disadvantageous side effect. In fact, the low speeds of the mobile masses prevent the rifle from regularly recocking when it is used for firing cartridges below a certain weight and therefore, power.

Inertial rifles therefore do not allow reliable operation for the entire wide range of power of cartridges that can be fired.

In fact at present, the most critical aspect of a modern semi-automatic hunting rifle is the high variety of the range and the relevant difference of cartridges it must fire.

The object of the present invention is to provide an individual firearm with improved recock device which should overcome the disadvantages of the prior art described above.

Another object of the present invention is to provide an individual firearm with improved recock device which should cover the entire range of cartridges that can be fired, combining good reliability for low powers with good resistance to stresses for high powers.

Another object of the present invention is to provide an individual firearm with improved recock device which should require little maintenance.

Another object of the present invention is to provide a firearm protected against excessive recock speeds.

These objects according to the present invention are achieved by an individual firearm with improved recock device according to claim 1.

Further features are described in the dependent claims.

The features and advantages of an individual firearm with improved recock device according to the present invention will appear more clearly from the following description, made by way of an indicative non-limiting example with reference to the annexed schematic drawings, wherein.

Figure 1:
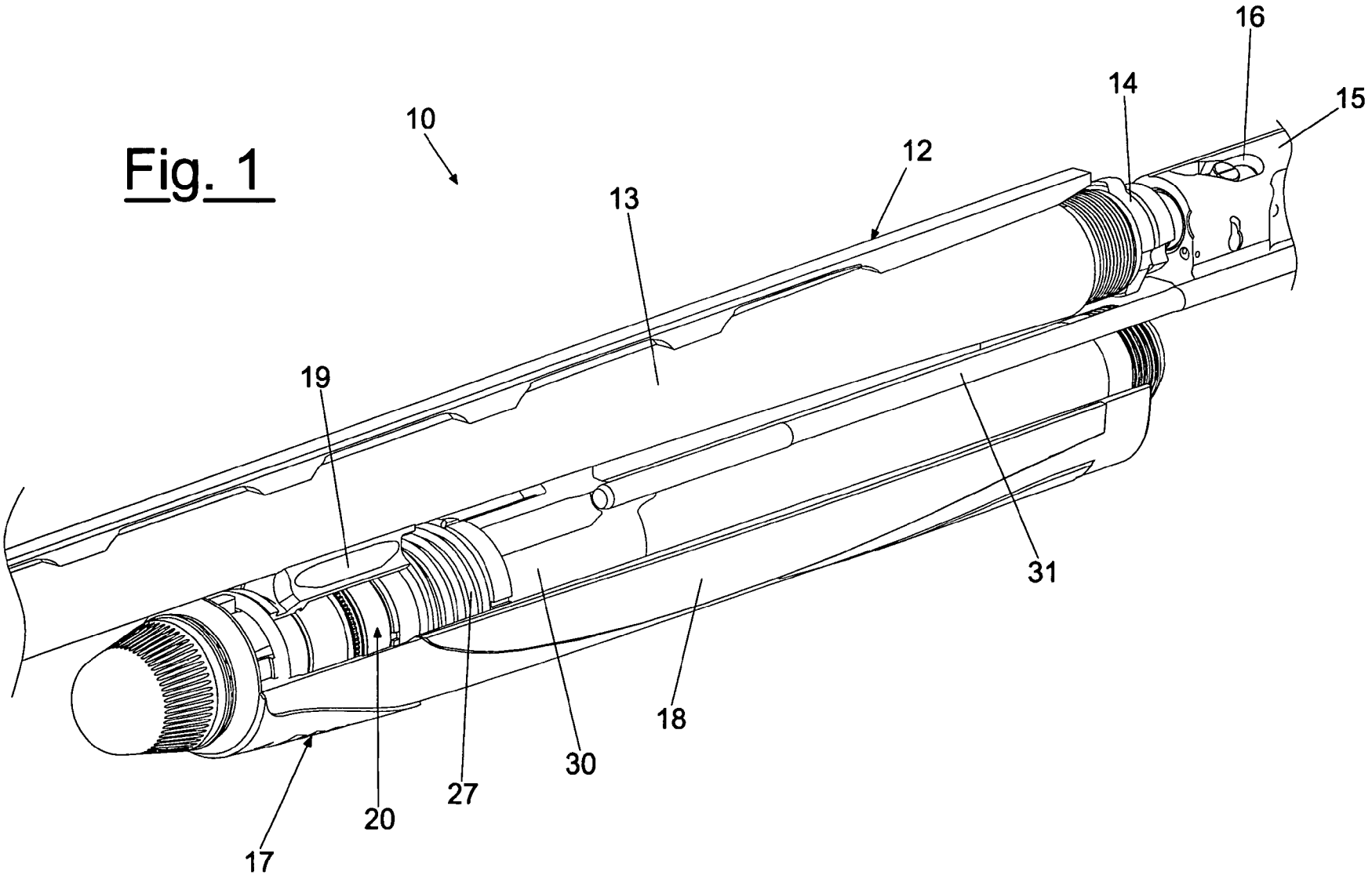
FIG. 1 is a partially cutaway axonometric view of a first embodiment of an individual firearm with improved recock device, object of the present invention.

With reference to the figures, there is shown an individual firearm with improved recock device, globally indicated with 10 or 10' and comprising a casing 12, a barrel 13, a rotating head breech bolt 14, a breech bolt slide 15, and a breech bolt release cam 16, which controls the opening through the rotation of the breech bolt 14.

As shown in FIG. 1, firearm 10 according to a first embodiment of the present invention, carries at the bottom relative to barrel 13, a recock device 17 contained inside a protective rod 18, shown in cutaway view for clarity of representation. The recock device comprises a gas intake cylinder 19, also shown in FIG. 1 in cutaway view, a piston gas intake assembly 20, contained inside cylinder 19, a sleeve 30 and two operating rods 31 integral to the breech bolt slide on opposed sides and in lower position relative to barrel 13.

The gas intake cylinder 19 is integrally connected to barrel 13 and put in communication therewith through one or more holes 32, or gas bleeding ports.

Figure 2:
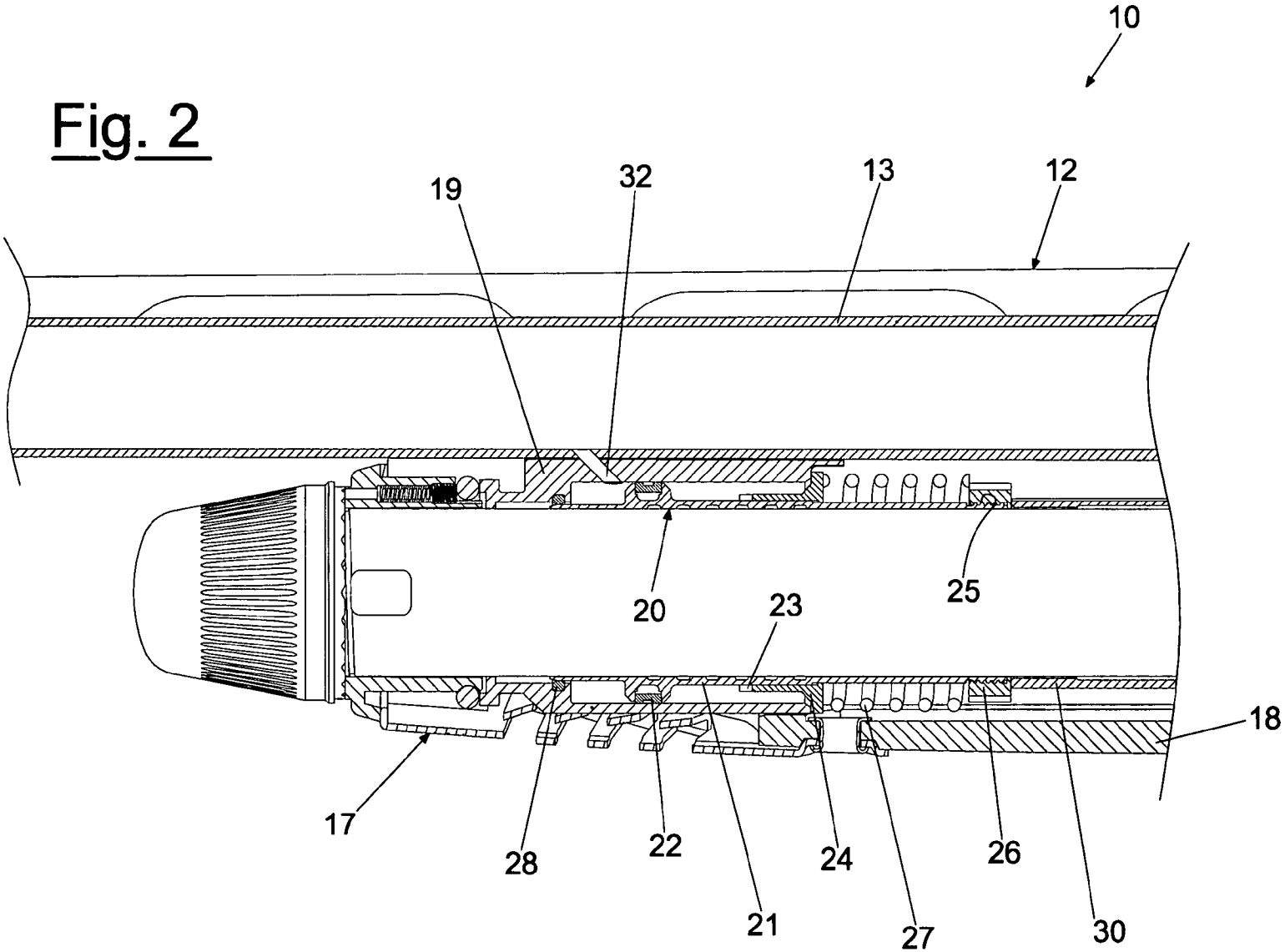
FIG. 2 is a partially cutaway and enlarged longitudinal section view of the improved recock device of the firearm of FIG. 1 in static rest conditions.

The piston gas intake assembly 20, as shown with better clarity in the section of FIG. 2, comprises a piston body 21, provided with elastic band 22 for the seal relative to cylinder 19, and provided with a support shoulder 23, for a flange 24, as well as a threaded rear end 25 whereon a ring nut 26 is screwed for containing a helical spring 27 which acts between flange 24 and ring nut 26. At the opposed end, a sealing ring 28 of the OR type (o-ring) is arranged between cylinder 19 and piston body 21, for example within an annular seat obtained on the inside surface of cylinder 19.

Moreover, FIG. 2 shows the front end of sleeve 30 pushed in contact with ring nut 26, in closed position, by the return spring, not shown.

Figure 6:
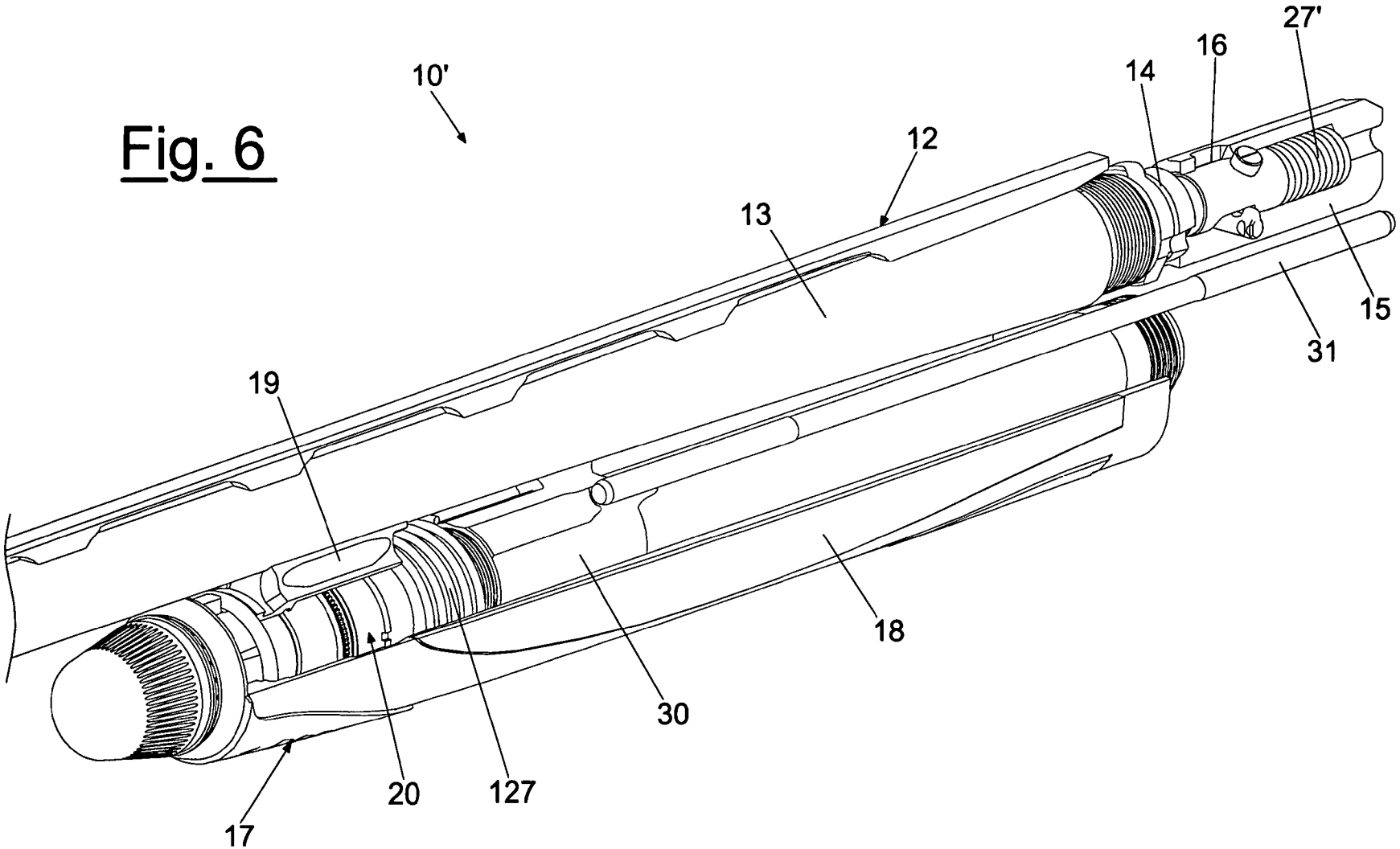
FIG. 6 is a partially cutaway axonometric view of a second embodiment of an individual firearm with improved recock device, object of the present invention.

FIG. 6 shows a second embodiment of a firearm 10' according to the present invention, wherein the inertial spring 27 fitted on the piston body shown in the previous figures from 1 to 4 is replaced with a first inertial spring 27' arranged between breech bolt slide 15 and breech bolt 14, or in the position where it is located in the most common and widespread inertial rifles currently produced.

On the other hand, on the piston body 21 there is fitted a second spring 127 of considerably lower strength, with a slight pre-load and having the only purpose of restoring, shot after shot, the relative position of the two portions it works between, that is, piston body 21 and flange 24.

Figure 3:
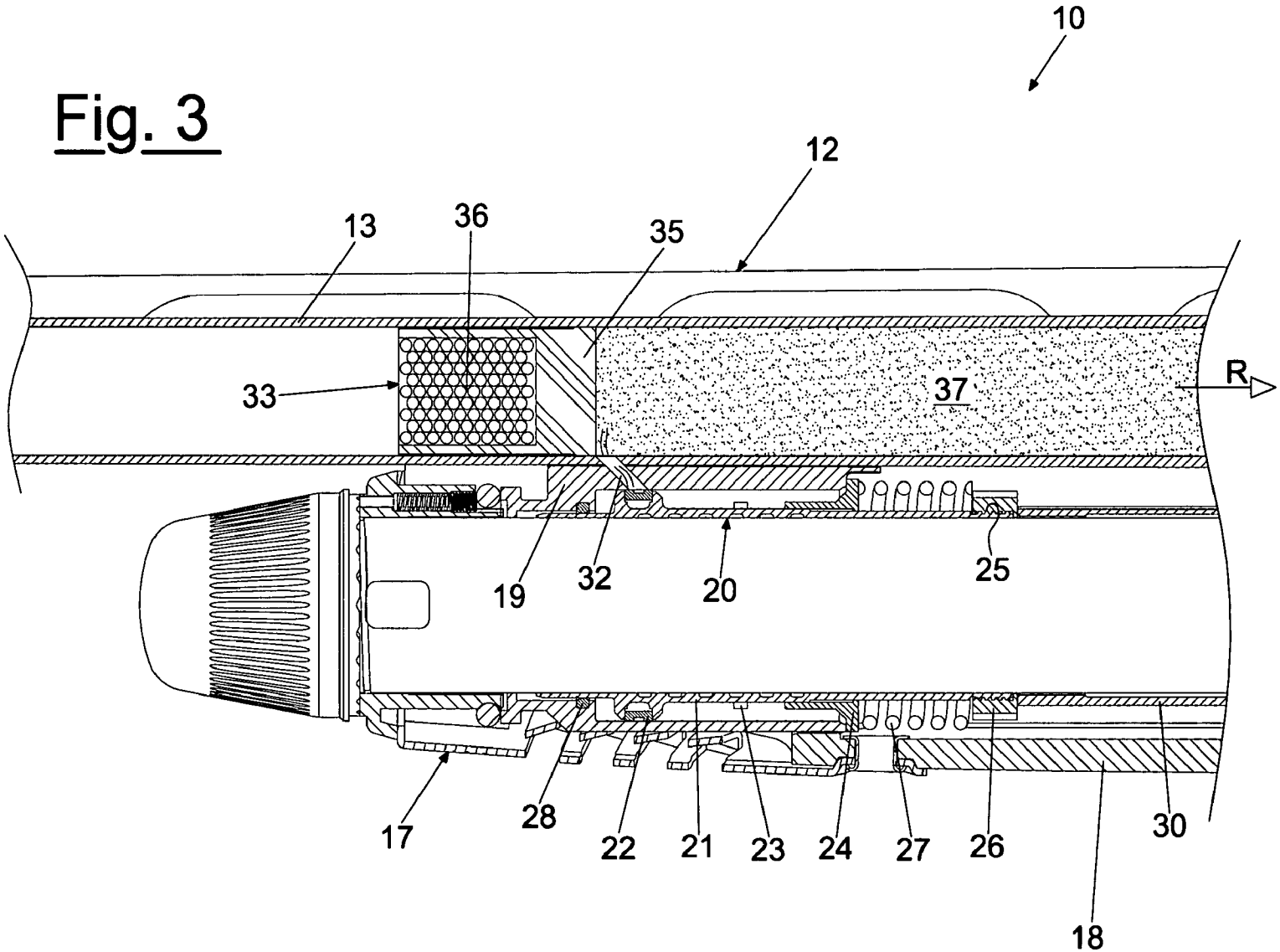
FIGS. 3 and 4 show in longitudinal sections corresponding to FIG. 2, the conditions of maximum spring compression respectively during the firing of a high power cartridge, for example the Magnum, and of a weak cartridge, for example of 24 g.
Figure 4:
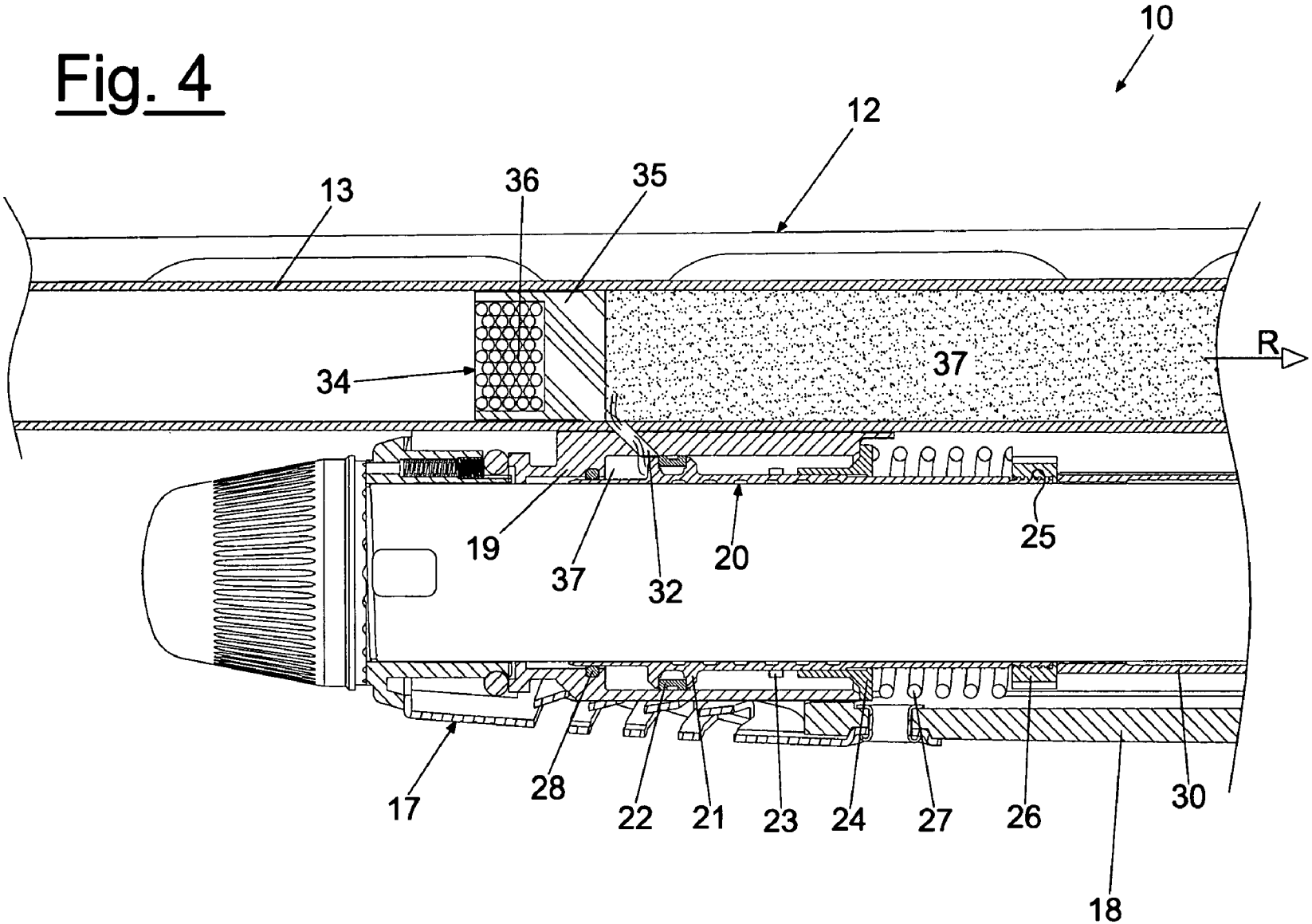

The operation of the individual firearm with improved recock device 10, object of the present invention, is described with particular reference to the examples of FIGS. 3 and 4, which schematically show respectively the firing of a strong cartridge 33 type Magnum or SuperMagnum as well as the firing of a weak cartridge 34, in the first embodiment of firearm 10.

The operation of firearm 10' shown in FIG. 6 shall not be described in detail as it is substantially unchanged as compared to what described with reference to the first embodiment.

FIG. 3 shows the situation in which, due to effect of the firing of the strong cartridge 33, a wad 35 for containing a launch charge 36, pushed by gases under pressure 37, arrives in the proximity of the bleeding ports 32, which connect the inside of barrel 13 with the gas intake cylinder 19.

FIG. 3 clearly shows that such communication is, on the other hand, prevented in the firing of strong cartridges 33 since, unlike what shown in the rest situation of FIG. 2, the relative position between piston body 21 and gas intake cylinder 19 is such that the elastic sealing band 22 fitted on piston body 21 completely closes the gas bleeding ports 32.

In fact, in the shot, due to the recoil, casing 12 and therefore also gas intake cylinder 19 integral thereto, move back according to arrow R relative to the breech bolt slide 15, to which piston assembly 20 is strictly connected through operating rods 31 and sleeve 30.

Spring 27, which behaves as the spring of an inertial rifle, compresses, thus causing the occlusion, in the shot of strong cartridges 33, of the gas bleeding ports 32 by the piston body 21, or of a covering element of ports 32, to spread again in order to recock the breech bolt slide 15 pushing it backwards.

For this operation, the inertial spring 27, having a minimum pre-load at rest but higher than the return spring strength, must have such elastic constant as to ensure a motion law of the piston body 21 which should allow covering the ports for the entire duration of the pressure inside barrel 13 to prevent inlet of gas 37 into cylinder 19. At the same time, it must ensure a suitable rifle opening delay. This is possible through a proper sizing of the inertial spring 27 and of its initial pre-load in relation to the total masses of the rifle, to the mobile masses and to the type of cartridge fired.

FIG. 4 shows the operation in the case of firing of the weal cartridge 34. Also this figure ideally shows the moment when the passage of wad 35 above the gas bleeding ports 32 puts barrel 13 in communication with cylinder 19, thus allowing the passage of gases under pressure 37.

This time, the position of the gas intake cylinder 19 relative to piston body 21 is more forward as compared to the previous case. Piston body 21 does not cover the gas bleeding ports 32 since the compression of the inertial spring 27, due to the weakness of the fired cartridge 34 and the consequent lower acceleration of casing 12, is lower, and effectively allows the inlet of gases 37, as schematised in FIG. 4.

In this case, the efficacy of the operation is ensured by the absence of covering of ports 32 for the entire stay of the pressure inside barrel 13 and this condition can be obtained by suitable calibration of the position of piston body 21 in the initial moment (at rest).

For proper operation of the firearm according to the invention, in the firing of weak cartridges 34, during which as described both spring 27 and the gas pressure collaborate to causing an acceleration of the mobile masses for the recock, the spring and gas thrust actions must be phased, that is, not opposed to one another.

Figure 5:
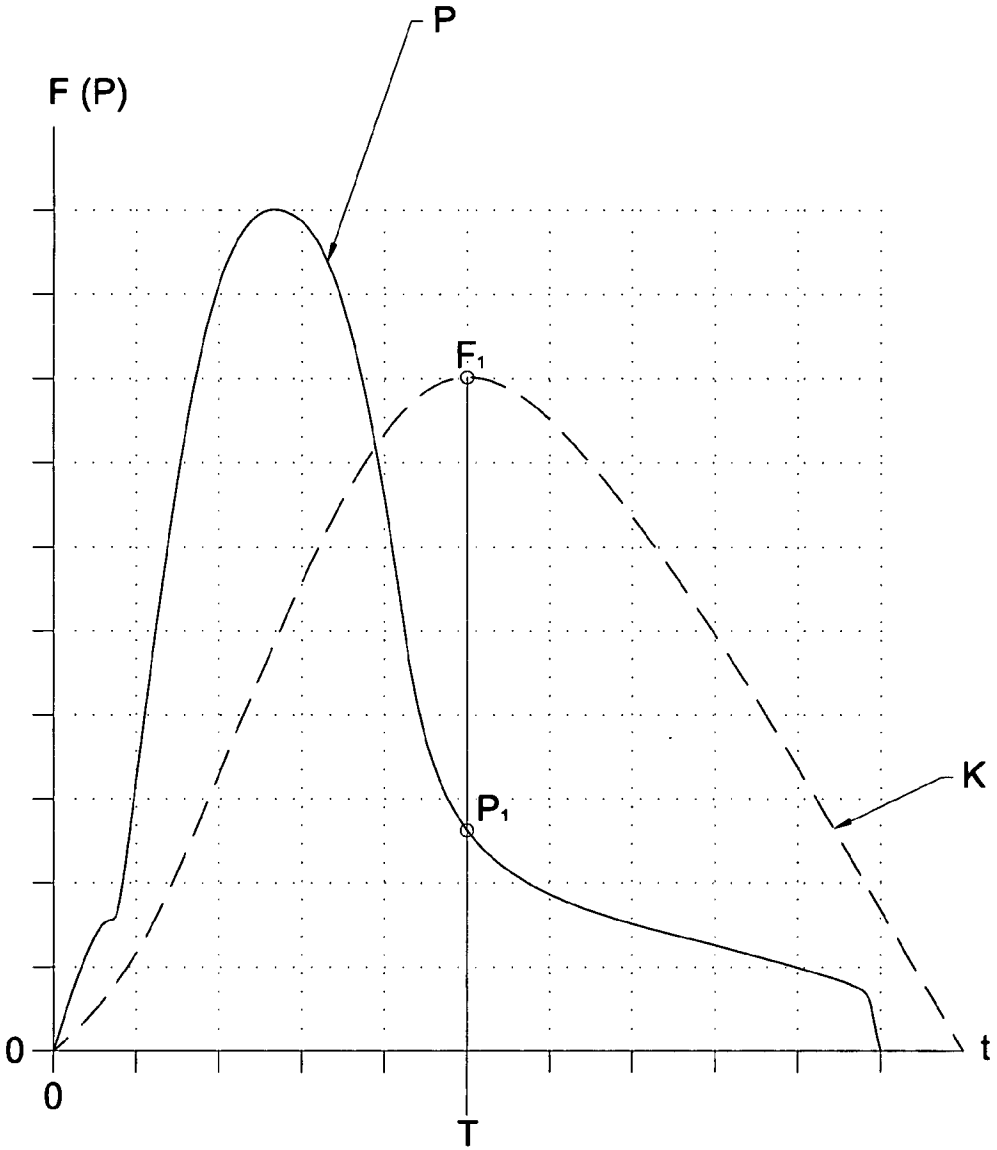
FIG. 5 shows a schematic diagram of the pressure trend over time following a shot, for example of a weak 24 g cartridge, in uninterrupted line, overlapped to the characteristic response curve of the inertial spring with a dashed line.

The correct sizing of spring 27, or of its elastic constant, is schematically shown in the diagram of FIG. 5, where pressure trend over time following a shot, for example of a weak 24 g cartridge, is shown with an uninterrupted line (P) and overlapped to the characteristic response curve of the inertial spring (K) shown with a dashed line.

At a time instant T, in which wad 35 passes above the gas bleeding ports 32 (FIG. 4) the gas bleeding 37 of barrel 13 and therefore the thrust of gases 37 on the gas intake piston 21 begin. Bled gases 37 have a pressure PI indicated in the diagram on the pressure curve (P). Given the characteristic of spring (K) shown in the diagram, at the same moment T the spring is at the top dead centre, from where the spreading step and the thrust with an initial force FI begins, as shown in FIG. 5.

In the case of weak cartridges, the individual firearm with improved recock device according to the present invention advantageously adds the thrust of the inertial spring to that of the gases and, even though it is lower as compared to the case of Magnum cartridges, it is present, thus offering a further thrust, very important due to the basically low speeds that can be obtained with these types of cartridges. Moreover, since the firing of weak cartridges uses both the gas and the inertial spring thrust, without limitation of the performance as compared to the operation of a standard gas intake rifle, where "performance" means the capacity of ejecting the case of a weak cartridge, it is possible to decrease the gas intake port diameter, to the advantage of less soiling of the piston/cylinder and of the rod inside, by the effect of the lower amount of gas bled from the barrel and then ejected. An additional advantage is therefore achieved.

This advantage is especially important as it makes maintenance less difficult and, keeping the rifle in optimum operating conditions, it contributes to higher reliability.

Moreover, the rifle is advantageously protected from excessive speed in the unlikely event of locking of the flange on the piston body. In this case, in fact, the rifle would work as gas intake also in the firing of strong cartridges but, in consideration of the reduction of the ports diameter, with speeds widely within the acceptable limits.

In the case of firing with strong cartridges, on the other hand, the firearm according to the present invention advantageously has, in standard operating conditions, a behaviour perfectly similar to that of an inertial rifle, since the backward thrust of the masses for recocking is provided only by the inertial spring.

The recock speeds and thereby the mechanical stresses on the firearm are therefore limited.

Several changes and variations can be made to the individual firearm with improved recock device thus conceived, all falling within the invention; moreover, all details can be replaced with technically equivalent elements. In the practice, the materials used as well as the sizes, can be whatever, according to the technical requirements.

The invention claimed is:

1. An individual firearm with improved recock device comprising:

a casing (12), a barrel (13), a breech bolt (14), a breech bolt slide (15), said barrel (13) being housed in casing (12) and comprising at least one gas bleeding port (32), which communicates with a gas intake cylinder (19) which in turn houses a piston gas intake assembly (20), said piston gas intake assembly (20) being connected to operating rods (31) which arc connected to said breech bolt slide (15), which is connected to the breech bolt (14) at an end of said barrel (13), said piston gas intake assembly (20) comprising inertial spring (27) which is compressible by the recoil of the casing and breech bolt (14) by the firing of a cartridge, said inertial spring (27) being positioned between said breech bolt slide (15) and said gas intake cylinder (19), said gas intake cylinder (19) having a piston body (21) which is capable of moving independently of the piston gas intake cylinder (20) by force resulting from firing a cartridge, said piston gas intake assembly (20) further comprising an elastic scaling band (22) which is adapted to close said at least one gas bleeding port (32) when sufficient force is applied to inertial spring (27) by the firing of said cartridge, said elastic sealing band (22) being fitted on piston body (21), said inertial spring being a helical spring which is arranged so that in response to the firing of a cartridge, said piston body (21) and said inertial helical spring cause said operating rods (31) to recock said firearm.

2. A firearm according to claim 1, wherein said piston body (21) having an elastic sealing band (22) adapted for closing said gas bleeding ports (32), said elastic sealing band being positioned at an end of said piston body (21) which is opposite to an end of said piston body (21) which has a ring nut element (26) which communicates with a fixed point of said inertial spring (27) of the piston gas intake assembly (20) so as to contain said inertial spring while under compression, said piston body (21) further comprising a flange (24) which is capable of sliding along said piston body (21), to exert a compressive force on mobile paint of said inertial spring of piston gas intake assembly (20).

3. A firearm according to claim 1, wherein piston body (21) is calibrated to change its resting position with respect to gas bleeding ports (32) during the firing of strong cartridges (33) said piston body (21) has a relative in dial advance motion relative to said gas intake cylinder (19) for an inertial operation of said firearm, which completely closes said gas bleeding ports (32) to gases (37) wider pressure in said barrel (13), and during the firing of weak cartridges (34), said piston body (21) has a lower relative advance motion as compared to the motion of piston body (21) during firing of strong cartridges (33), which causes said piston body (21) not to interfere with said ports (32) so that said ports (32) remain open to allow said gases (37) to act on said piston body (21).

4. A firearm according to claim 1, wherein inertial spring (27) has an elastic characteristic by which the moment of maximum compression under the effect of the recoil of said casing (12), coincides with the gas bleeding through gas bleeding port (32) in the firing of weak cartridges (34), or with the passage of a wad (35) of a weak cartridge (34) on said gas bleeding ports (32), to recock the firearm.

5. An individual firearm with improved recock device comprising:

a casing (12), a barrel (13), a breech bolt (14), a breech bolt slide (15), said barrel (13) being housed in casing (12) and comprising at least one gas bleeding port (32), which communicates with a gas intake cylinder (19) which in turn houses a piston gas intake assembly (20), said piston gas intake assembly (20) being connected to operating rods (31) which are connected to said breech bolt slide (15), which is connected to the breech bolt (14) at an end of said barrel (13), said piston gas intake assembly (20) comprising a piston body (21) in gas intake cylinder (19), said piston body (21) being in contact with operating rods (31), said firearm having an inertial spring (27') arranged between said breech bolt (14) and said breech bolt slide (15) where it is compressed by the recoil of breech bolt (14) against said breech bolt slide (15), said gas intake cylinder (19) being adapted to receive gas (37) resulting from firing a cartridge, said gas (37) being passed from barrel (13) to said gas intake cylinder (19) though said gas bleeding port (32) where said gas exerts a force on said piston body (21) and said piston body (21) in cooperation with said compressible inertial spring (27') exerts a force on said operating rods (31) that recock said firearm wherein piston body (21) is calibrated to change its resting position with respect to said at least one gas bleeding port (32) during the firing of strong cartridges (33) said piston body (21) having a relative inertial advance motion relative to said gas intake cylinder (19) for an inertial operation of said firearm, which completely closes said gas bleeding ports (32) to gases (37) under pressure in said barrel (13), and during the firing of weak cartridges (34), said piston body (21) has a lower relative advance motion as compared to the motion of piston body (21) during firing of strong cartridges (33), which causes said piston body (21) not to interfere with said ports (32) so that said ports (32) remain open to allow said gases (37) to act on said piston body (21).

6. A firearm according to claim 5 wherein said piston gas intake assembly (20) comprises a second return spring (127) so as to return the said flange (24) to a position in said gas intake piston body (21).

7. A firearm according to claim 5, wherein said inertial spring (27') has an elastic characteristic by which the moment of maximum compression under the effect of the recoil of said casing (12), coincides with the gas bleeding through gas bleeding port (32) in the firing of weak cartridges (34), or with the passage of a wad (35) of a weak cartridge (34) on said gas bleeding ports (32), to recock the firearm.

* * * * *

UNITED STATES PATENT AND TRADEMARK OFFICE

CERTIFICATE OF CORRECTION

PATENT NO. : 7,610,843 B2
APPLICATION NO. : 11/191836
DATED : November 3, 2009
INVENTOR(S) : Ugo Gussalli Beretta It is certified that error appears in the above-identified patent and that said Letters Patent is hereby corrected as shown below:

Title page, item (73) should read as follows:

(73) Assignee: Fabbrica d'Armi Pietro Beretta S.p.A.

Signed and Sealed this

Sixteenth Day of March, 2010

David J. Kappos

David J. Kappos
*Director of the United States Patent and Trademark Office*